US010822217B2

(12) United States Patent
Brandes

(10) Patent No.: US 10,822,217 B2
(45) Date of Patent: Nov. 3, 2020

(54) BOTTLE OPENER BRACKET

(71) Applicant: Visual Promotions, LLC, Sealy, TX (US)

(72) Inventor: Jeffrey William Brandes, Cat Spring, TX (US)

(73) Assignee: Visual Promotions, LLC, Sealy, TX (US)

( * ) Notice: Subject to any disclaimer, the term of this patent is extended or adjusted under 35 U.S.C. 154(b) by 243 days.

(21) Appl. No.: 15/851,043

(22) Filed: Dec. 21, 2017

(65) Prior Publication Data

US 2018/0170735 A1 Jun. 21, 2018

Related U.S. Application Data

(60) Provisional application No. 62/437,478, filed on Dec. 21, 2016.

(51) Int. Cl.
*B67B 7/16* (2006.01)
*B67B 7/18* (2006.01)

(52) U.S. Cl.
CPC . *B67B 7/16* (2013.01); *B67B 7/18* (2013.01)

(58) Field of Classification Search
CPC ..... B67B 7/16; B67B 7/44
USPC ..... 81/3.27, 3.25
See application file for complete search history.

(56) References Cited

U.S. PATENT DOCUMENTS

| | | | | | |
|---|---|---|---|---|---|
| 747,119 | A * | 12/1903 | Barry | A44C 1/00 | 24/13 |
| 1,104,025 | A * | 7/1914 | Vaughan | B67B 7/44 | 81/3.09 |
| 1,731,408 | A * | 10/1929 | Finnessy | A47G 25/0607 | 81/3.09 |
| 2,261,729 | A * | 11/1941 | Miller | B67B 7/30 | 30/1.5 |
| D406,504 | S * | 3/1999 | Herrmann | D8/37 | |
| D488,689 | S * | 4/2004 | Smith, IV | D8/18 | |
| 7,182,001 | B2 * | 2/2007 | Rivera | B25F 1/04 | 81/177.4 |
| 7,343,835 | B2 * | 3/2008 | Jensen | B67B 7/18 | 81/3.09 |
| 10,118,812 | B2 * | 11/2018 | Ochipa | B67B 7/16 | |
| 2003/0137833 | A1 * | 7/2003 | Hsu | A44B 15/005 | 362/196 |

* cited by examiner

*Primary Examiner* — Hadi Shakeri
(74) *Attorney, Agent, or Firm* — Conley Rose, P. C.; William H. Dietrich

(57) ABSTRACT

A bottle opener bracket and method of forming a bottle opener bracket comprises a first bottler opener formed on a metal body; a second bottle opener formed on the metal body; and a clip formed on the metal blank, wherein the clip comprises a channel between the clip and the metal body, wherein the clip is configured to receive an object within the channel such that the object is frictionally coupled to the clip securely.

10 Claims, 6 Drawing Sheets

BOTTLE OPENER BRACKET

BACKGROUND

A hand-held bottle opener is often used to remove the top from bottled beverages. Some bottled beverages have pry-off tops, while others use twist-off tops. Unfortunately, removing the top from a bottled beverage having the pry-off top may require a bottle opener which is not readily available. In addition, removing the top from a bottled beverage having the twist-off top may result in harm to the individual opening the beverage.

In addition, a utility light or flashlight may be hard to locate when the need for a light source arises. For example, a light source may not be readily available to illuminate a campsite, a workshop, a tool box on the back of a pick-up truck, an attic, a storage unit, or an insulated cooler.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are various embodiments of a bracket having bottle openers of different types and configured to accept an optional light assembly. As will be more fully disclosed below, the bracket provides the benefit of a light source in combination with two bottle openers of different types. In other embodiments, the bracket may be configured to accept a smart phone, a mini portable device, a book, one or more hangers, keys, or any other similar items that can be secured to the bracket. The bracket may be conveniently mounted in a variety of different locations.

Figure 1:
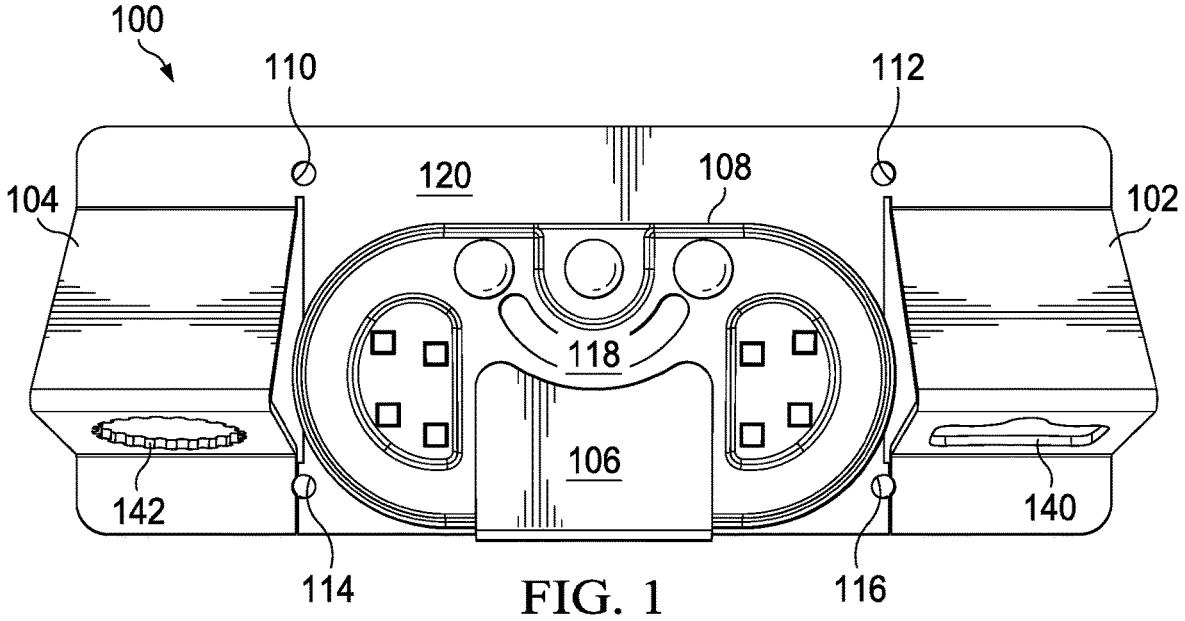
FIG. 1 is a front perspective view of a bracket with bottle openers and an optional light assembly in accordance with an embodiment.
Figure 2:
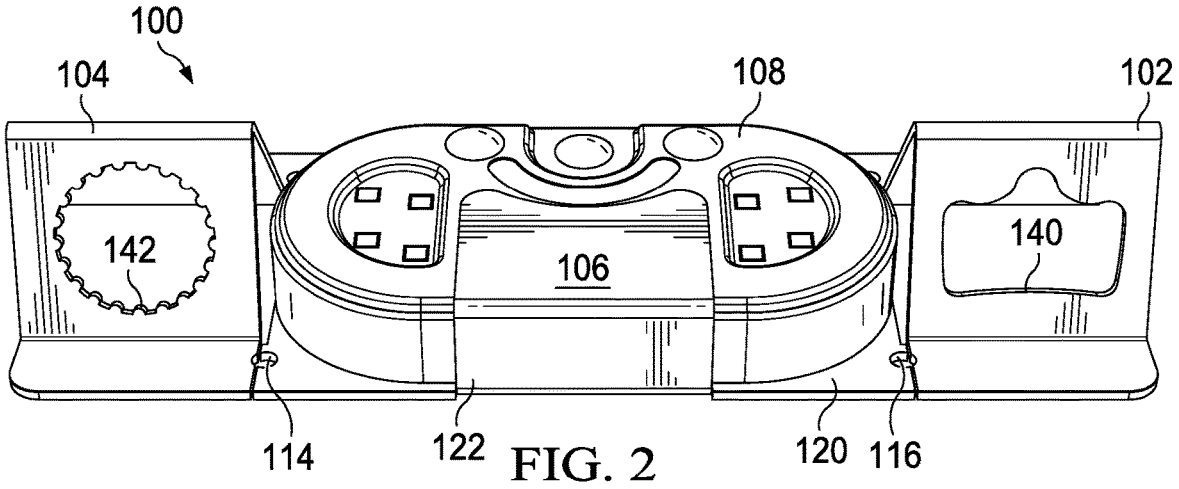
FIG. 2 is a bottom perspective view of the bracket of FIG. 1 taken from another viewpoint in accordance with an embodiment.

Referring to the figures, FIG. 1 is a front perspective view of an embodiment of a bracket 100 with two different bottle opener portions 102, 104 (hereinafter bottle openers 102, 104), and a clip portion 106 (hereinafter clip 106) for an optional light assembly 108. FIG. 2 is a bottom perspective view of an embodiment of the bracket 100 of FIG. 1 taken from another viewpoint. As shown in FIGS. 1-2, the bracket 100 includes two bottle openers 102, 104 having different configurations. In one example, bottle opener 102 comprises an aperture or opening 140 that is configured to receive a complementary shape of a pry-off cap of a beverage bottle. In another example, bottle opener 104 comprises an aperture or opening 142 that is configured to receive a complementary shape of a twist-off cap of a beverage bottle. It is to be appreciated that the apertures 140, 142 are formed in respective bottle openers 102, 104 such that apertures 140, 142 face downwards when the bracket 100 is installed in its intended orientation, as shown in FIG. 1, and a user of the bracket 100 can hold the beverage bottle upright as the user removes the cap or top off the beverage bottle. The two bottle openers 102, 104 are disposed on either side of clip 106 (a.k.a., base flap 106) holding the optional light assembly 108. Even so, the two bottle openers 102, 104 may be otherwise arranged. For example, both bottle openers 102, 104 could be on a same side (i.e., immediately adjacent to each other), above the clip 106 and light assembly 108, or below the light assembly 108.

Also shown in FIGS. 1-2, the bracket 100 includes a plurality of holes or circular apertures 110, 112, 114, and 116 configured to receive screws, bolts, or other fasteners. As such, the bracket 100 may be secured to, for example, the a wall or tub of an insulated cooler 200 (shown in FIG. 11), a wall of a utility room, a wall of a tool box on the back of a pick-up truck, in an attic, in a storage unit, grilling area, patio, porch, bar, etc. In an embodiment, four self-tapping galvanized screws (not shown) may be driven through the holes 110-116 into the object to which the bracket 100 is being mounted to secure the bracket 100 in place. In an embodiment, the bracket 100 is formed from aluminum or other metal and apertures 140, 142 in the bottle openers 102, 104 may be stamped during processing. Other durable materials may also be used without departing from the scope of the invention.

The optional light assembly 108 in FIGS. 1-2 includes a light source such as, for example, one or more light emitting diodes (LEDs). The light assembly 108 may include, for example, a light sensor and/or a motion sensor used to turn the LEDs of the light assembly 108 on when light or motion are sensed. The light assembly 108 may also have an on/off switch and a timer to turn the LEDs ON and OFF. The light assembly 108 may be waterproof or water resistant.

Figure 3:
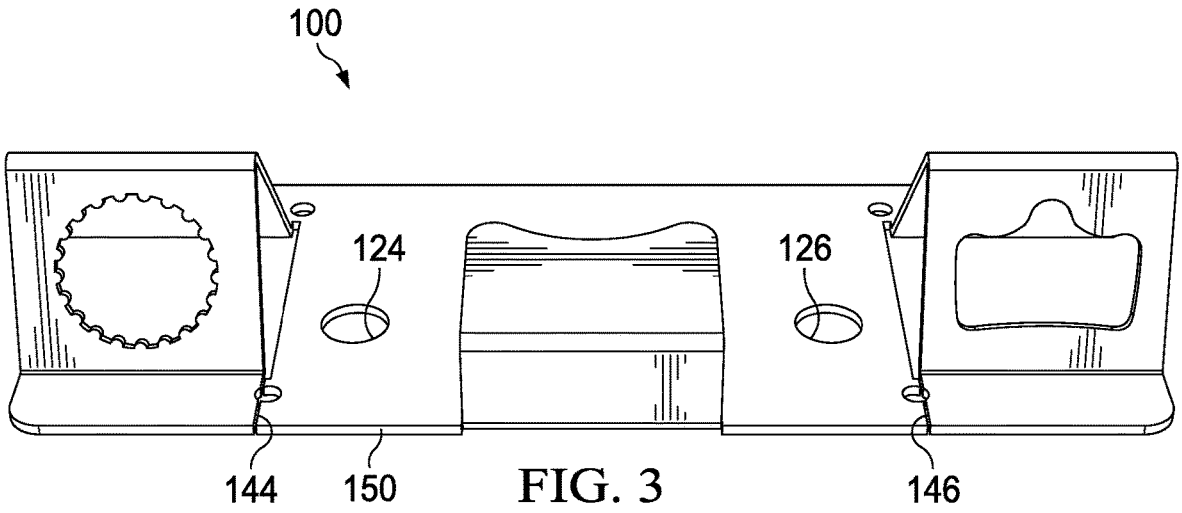
FIG. 3 is a bottom perspective view of the bracket with the light assembly removed in accordance with an embodiment.
Figure 4:
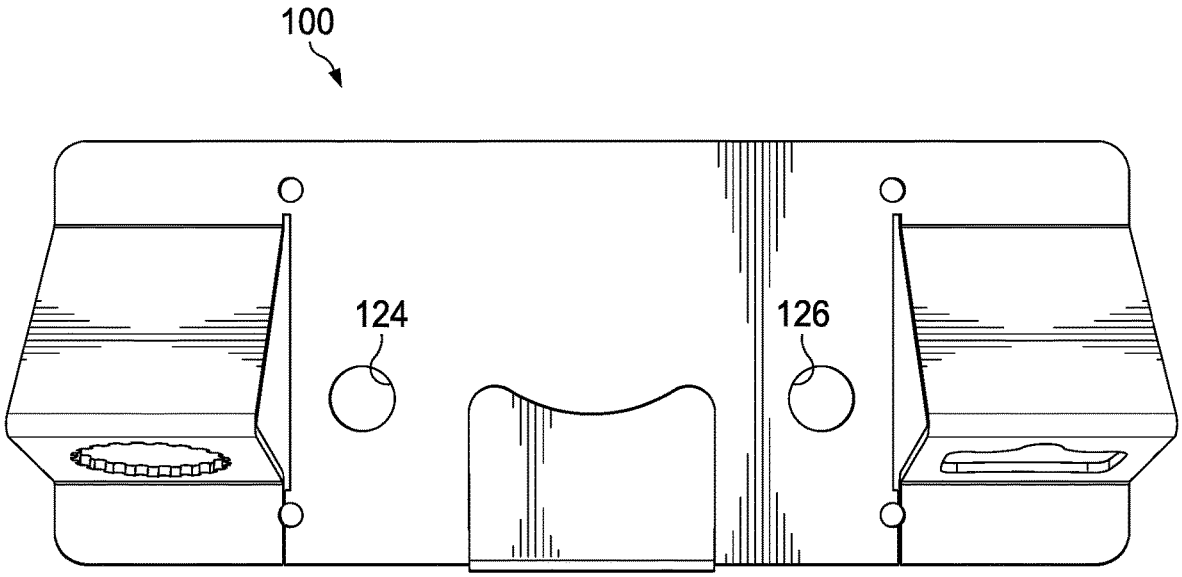
FIG. 4 is a front perspective view of the bracket of FIG. 3 taken from another viewpoint in accordance with an embodiment.

The light assembly 108 is removably secured in the bracket 100. In an embodiment, the light assembly 108 includes a pair of dimples on a rear surface (not shown) that is opposite a front surface 118. In an embodiment, the clip 106 may be formed by folding the bracket 100 at its lower portion 122 (FIG. 2) to form a channel or groove between the surface 120 and clip 106. When the light assembly 100 is slid beneath the clip 106 (i.e., within the channel or groove) disposed in the center of the bracket 100 as shown in FIGS. 1-2, the protruding dimples on the rear surface of the light assembly engage two holes 124, 126 disposed on either side of the clip 106. The clip 106 and the two holes 124, 126 are shown in FIGS. 3-4, in which the light assembly 108 has been temporarily removed. The clip 106 may provide a friction fit to hold the light assembly 108 within the groove or channel of the clip 106. In an embodiment, the clip 106, dimples, and holes or apertures 124, 126 collectively secure or maintain the light assembly 108 in the bracket 100. However, the light assembly 108 may be conveniently removed by a user when desired. Also shown in FIG. 3, elongated grooves 144, 146 may be formed in bracket 100 that traverse a substantial height of the bracket 100 and end at edge 150. These elongated grooves facilitate in bending the metal blank to form bottle openers 102, 104. Additionally, these grooves can flex independently of the metal body as the bottle openers 102, 104 are flexed during use so that stresses may be absorbed by the bottle openers 102, 104 and not at the fasteners that couple the bracket 100 to a surface, which can weaken the metal blank and/or the fastener connection.

Figure 5:
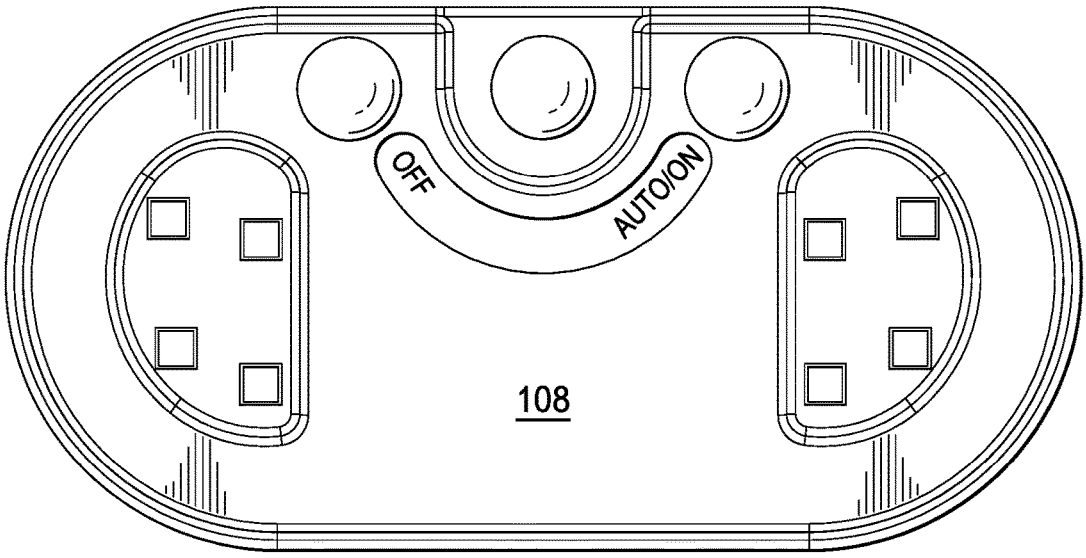
FIG. 5 is a front perspective view of the optional light assembly when removed from the bracket of FIG. 1 in accordance with an embodiment.
Figure 6:
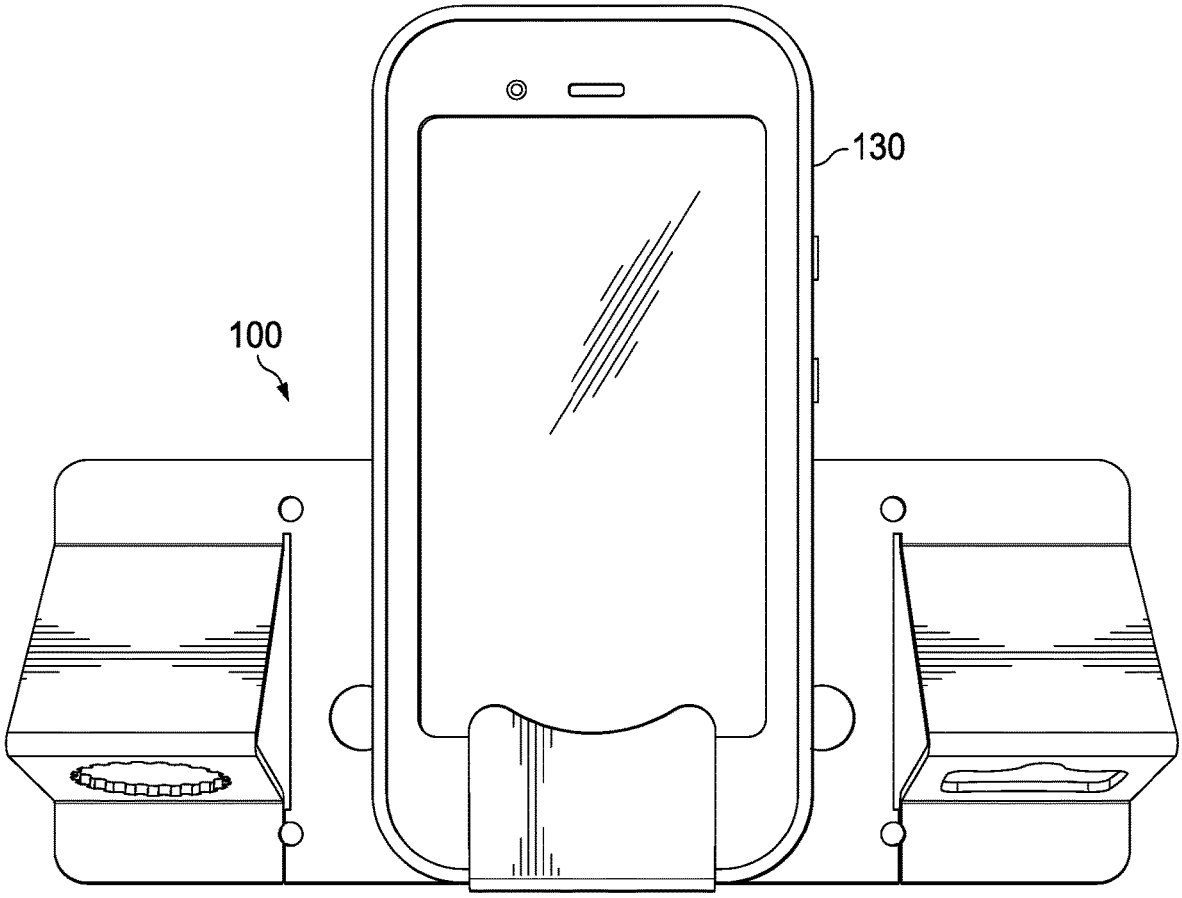
FIGS. 6-11 illustrate the bracket of FIG. 3 used to secure or suspend various items in accordance with various embodiments.
Figure 7:
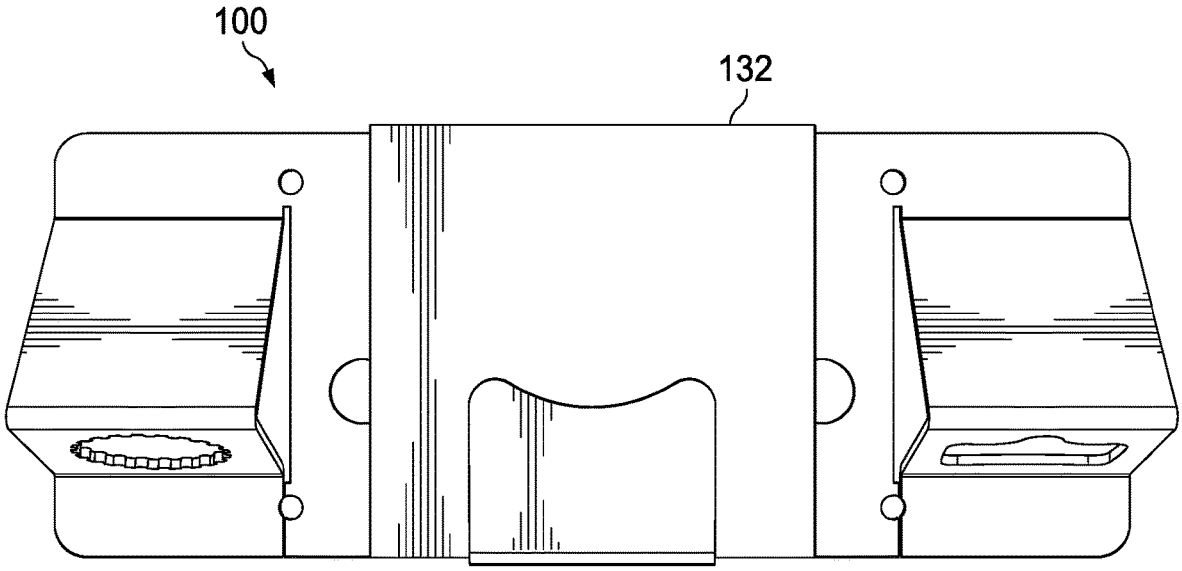
Figure 8:
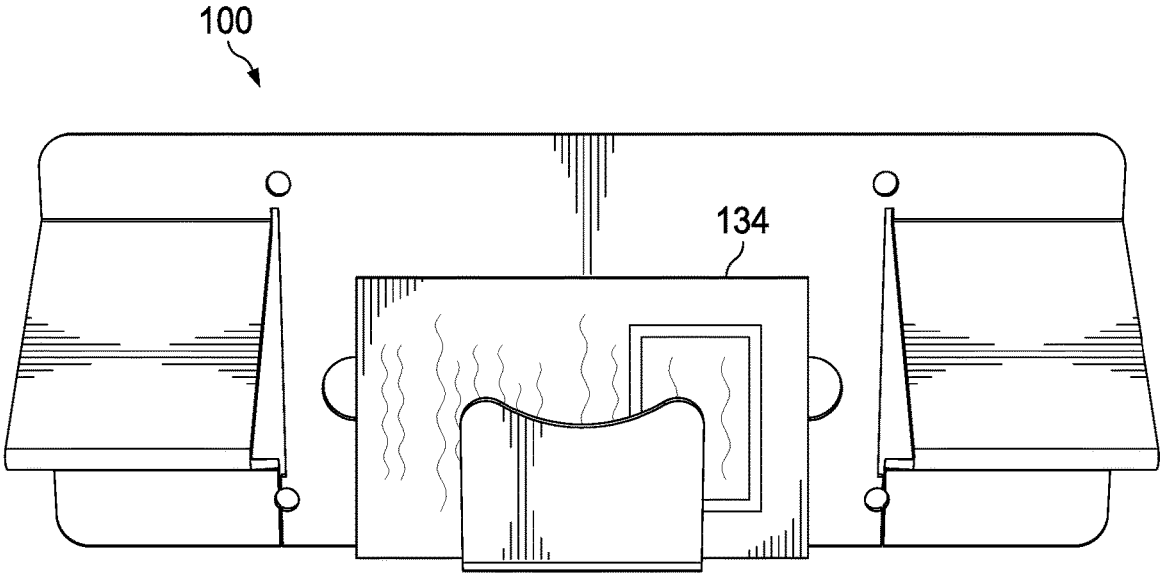
Figure 9:
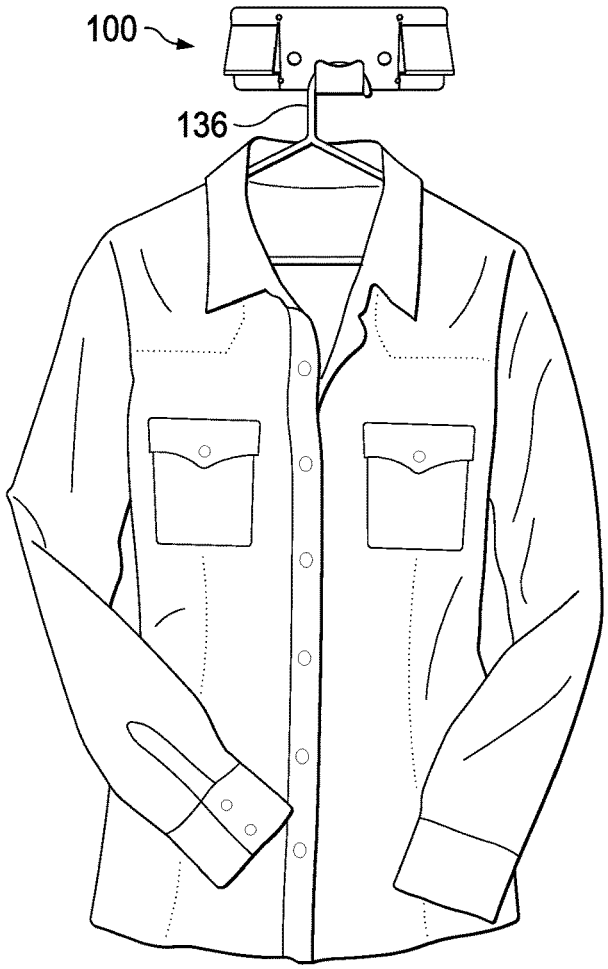
Figure 10:
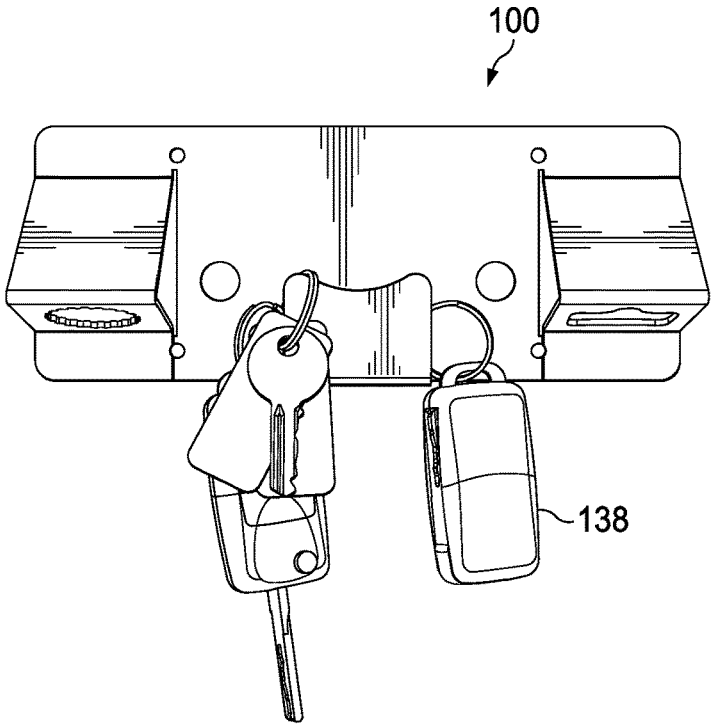

The bracket 100 may be mounted to a wall or to any surface so that the bottle openers 102, 104 are not lost or misplaced. For example, the bracket 100 may be mounted to a surface by inserting screws, bolts, or other fasteners into holes 110-116 (FIG. 1). The bracket 100 allows the light assembly 108 to have a stationary dock. Even so, the light assembly 108 may be removed as shown in FIG. 5 and used for some purpose other than to illuminate the area around the bracket 100. The light assembly 108 may be sized and shaped to be carried, for example, in a hand of a person so that the light assembly 108 can be used like a flashlight. The light assembly 108 may include a hook, hole, string or other structure permitting the light assembly 108 to be suspended or held in place when in use away from the bracket 100.

When the light assembly 108 is removed from the bracket, the bracket 100 may be used to secure or suspend other items as shown in FIGS. 6-11. In an embodiment, the channel within the clip 106 may be narrowed to receive these other items. Such items include, but are not limited to, a mobile phone 130 (FIG. 6), note pads 132 (FIG. 7), a book 134 (FIG. 8), a coat hanger 136 (FIG. 9), keys 138 (FIG. 10), etc. In an embodiment, two items may be inserted into the clip 106 at the same time to secure and suspend the items within the bracket 100 through friction such as, for example, a mobile phone 130 and a book may be inserted at the same time into clip 106.

The clip 106 or other portions of the bracket 100 may include designs or other indicia. For example, the clip 106 may have a star design embossed or engraved therein. The bracket 100 may be painted or otherwise colored to have a variety of different colors. The bracket 100 may include a logo or other design, a name, etc.

Figure 12:
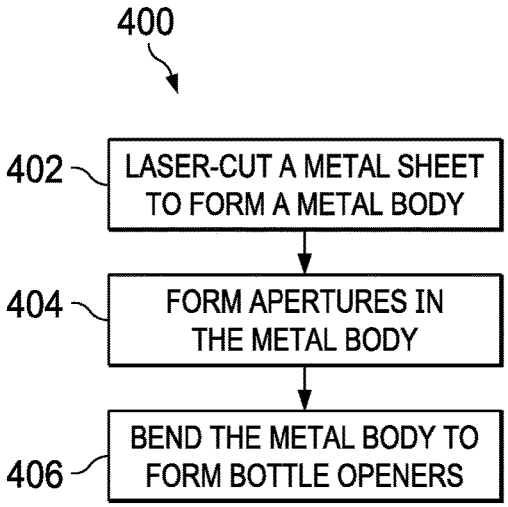
FIG. 12 illustrates a process for manufacturing the bracket of FIGS. 1-4 in accordance with an embodiment.

Referring to FIG. 12 and with continued reference to FIGS. 1-4, a method 400 for forming bracket 100 is provided in accordance with an embodiment. In 402, the bracket 100 may be formed by laser-cutting a sheet of aluminum (e.g., ⅛ inch sheet) to form a metal blank (or metal body). Once cut, in 404, the metal body may be subjected to cutting or stamping to form apertures in the metal body. In some examples, apertures 110-116, 140, 142 (shown in FIG. 2) and apertures 124, 126 (shown in FIGS. 3-4) may be provided in the metal body through stamping or laser cutting prior to metal-bending with a metal-bending machine. In 406, a metal-bending machine may be used to bend portions of the metal body to form bottle openers 102, 104 and achieve the shape illustrated herein. Other suitable methods of manufacturing may also be used.

Figure 11:
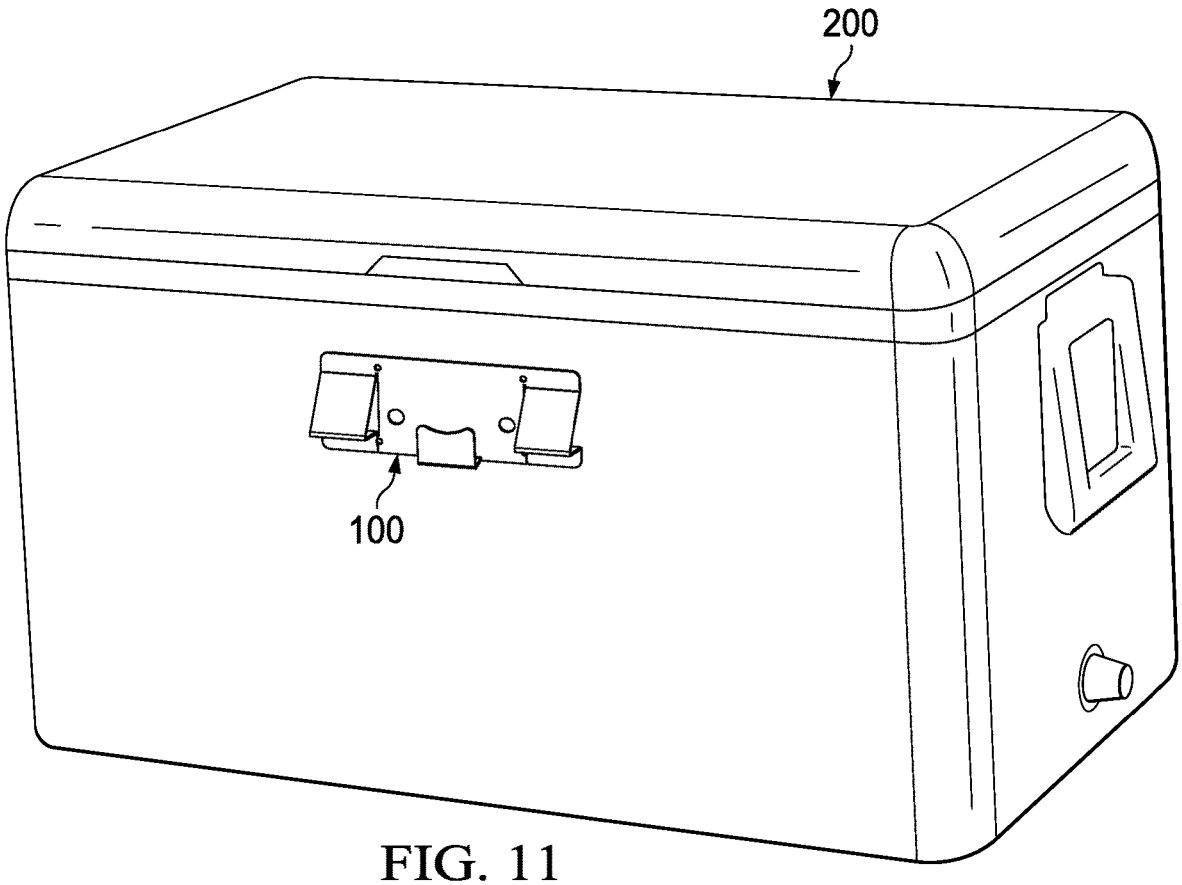

In one embodiment, the bracket 100 is screwed into a portion of an insulated cooler 200, as shown in FIG. 11. Therefore, a user of the insulated cooler 200 may take advantage of the dual bottle openers 102, 104 as well as the removable light assembly 108. Indeed, the interior of the insulated cooler 200 or the surrounding area may be illuminated with the light assembly 108. In addition, the light assembly 108 may be removed and used away from the insulated cooler 200.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A bottle opener bracket, comprising:

a first bottle opener formed on a metal body;

a second bottle opener formed on the metal body; and a clip formed on the metal body between the first bottle opener and the second bottle opener, wherein the clip comprises a channel between a rear surface of the clip and a front surface of the metal body, wherein the clip is configured to receive an object inserted downwardly toward a bottom surface of the channel such that the object is frictionally coupled to the clip, and wherein an aperture-containing surface of at least one of the first bottle opener and the second bottle opener faces downwardly in a direction of the bottom surface of the channel.

2. The bottle opener bracket of claim 1, wherein the object comprises at least one of a portable device, a notepad, a book, a key, a light assembly and a hanger.

3. The bottle opener bracket of claim 1, wherein the first bottle opener comprises a first aperture, wherein the first aperture is shaped to receive a complementary shape of a pry-off bottle cap of a beverage bottle.

4. The bottle opener bracket of claim 1, wherein the second bottle opener comprises a second aperture, wherein the second aperture is shaped to receive a complementary shape of a twist-off cap of a beverage bottle.

5. The bottle opener bracket of claim 1, wherein the metal body comprises aluminum.

6. The bottle opener bracket of claim 1, further comprising a plurality of elongated apertures formed in the metal body, wherein the elongated apertures are configured to flex independently of the metal body as the bottle openers are flexed during use.

7. The bottle opener bracket of claim 1, further comprising a plurality of circular apertures formed in the metal body, wherein one or more apertures are configured to receive respective fasteners.

8. The bottle opener bracket of claim 7, wherein the fasteners are configured to couple the bottle opener bracket to a surface of a beverage cooler.

9. The bottle opener bracket of claim 7, wherein the clip is configured to receive a light assembly within the channel such that the light assembly is securely coupled to the clip via a friction fit.

10. The bottle opener bracket of claim 9, wherein the light assembly comprises two protruding dimples on a rear surface of the light assembly, wherein each dimple of the two dimples is configured to engage a respective hole disposed on the metal body.

* * * * *